United States Patent [19]

Gabry et al.

[11] 4,385,471

[45] May 31, 1983

[54] OVERHEAD DOOR STOP

[75] Inventors: Frank F. Gabry, Des Plaines; Gene A. Borge, Plano, both of Ill.

[73] Assignee: McKee Door Company, Aurora, Ill.

[21] Appl. No.: 304,838

[22] Filed: Sep. 23, 1981

[51] Int. Cl.[3] ..... E05D 17/00

[52] U.S. Cl. ..... 49/322

[58] Field of Search ..... 49/322; 187/81-88

[56] References Cited

U.S. PATENT DOCUMENTS

| | | | |
|---|---|---|---|
| 2,084,677 | 6/1937 | Gerken | 49/322 X |
| 2,095,695 | 10/1937 | Greegor | 49/322 |
| 2,185,828 | 1/1940 | Blodgett | 49/322 |
| 2,651,817 | 9/1953 | Moler | 49/322 X |
| 2,869,183 | 1/1959 | Smith | 49/322 |
| 3,188,698 | 6/1965 | Zoll et al. | 49/322 |

FOREIGN PATENT DOCUMENTS

| | | | |
|---|---|---|---|
| 1382705 | 2/1975 | United Kingdom | 49/322 |

*Primary Examiner*—Philip C. Kannan

*Attorney, Agent, or Firm*—McWilliams, Mann, Zummer & Sweeney

[57] ABSTRACT

The invention is directed to a stop device for a lift type overhead door such as may be counterbalanced by springs and cables and having guide rollers operating in guide tracks at opposite sides of the door. The stop fixture is disposed one at each side of the door and includes a pivoted door stopping dog having an operating arm extending generally parallel to a door supporting cable. The dog is positioned at one side of a track flange directly opposed to a roller at the opposite side of such flange and the dog with its operating arm are tied to this roller in a fixed dimension relationship. The operating arm is connected to a door supporting cable so that if the cable breaks the arm is immediately actuated by a spring to swing the dog into engagement with the track flange, backed up by the opposed roller at the other side of the flange, to grip the flange therebetween and thus prevent the door from falling.

6 Claims, 4 Drawing Figures

OVERHEAD DOOR STOP

BACKGROUND OF THE INVENTION

1. Field of the Invention

The invention is directed to a stop fixture for use on overhead doors of the lift type which operate in side tracks by means of rollers and cable supported for movement from a vertical operative position to a horizontal overhead position.

2. Description of the Prior Art

Heretofore, door safety stops have been provided to prevent doors from falling in the event of failure of some supporting structure, particularly cables which are subjected to wear and deterioration in service and if not replaced periodically, ultimate breakage. The prior art revealed in the patent literature disclose braking devices such as the separate safety rail of U.S. Pat. No. 2,084,677 which is engaged at one side by a roller 31 and by a cam 33 which is brought to bear on the safety rail by breakage of a hoisting chain 13. The door is guided in tracks 15 by rollers 14 and the safety rail 30 and the roller 31 and cam 33 function separately from this door guiding function.

Greegor U.S. Pat. No. 2,095,695 also discloses a separate vertical rail apart from the door guiding mechanism which includes flange 4, roller 5 and the flange 9 embraced by the wear plates 6 and 7. The locking rail 23 includes a flange 22 that is adapted to be engaged by a locking bit 19 to prevent the door from falling in the event of failure.

U.S. Pat. No. 2,185,828 to Blodgett provides a safety catch for a vertically acting door that operates in tracks by means of rollers, but utilizes a bottom fixture at each side of the door that incorporates a safety catch, or clutch, which does not rotate during normal operation of the door, but in the event of failure the catch will be engaged within the track in a wedging action to prevent downward movement of the door.

Moler U.S. Pat. No. 2,651,817 describes a safety catch arrangement that involves a dual action having a first frictional wedging engagement and then a piercing engagement if the first engagement slips.

U.S. Pat. No. 3,188,698 to Zoll et al. uses a pawl in the channel shaped guide track having teeth that engage the channel and after initial engagement additional teeth come into operation as the guide channel is dented and expanded by the pawl action.

The overhead door industry has not had a reliable device to prevent such doors from falling in the event of cable breakage. Most such door manufacturers while they have used door stopping devices, the stops were either unreliable or restricted to smaller and lighter weight doors.

SUMMARY OF THE INVENTION

The invention is applicable to a lift type overhead operating door of the type that is counterbalanced by springs and connecting cables and comprises a bottom fixture installed at opposite sides of the door as a stop to prevent the door from falling in the event that the cable breaks. The fixture is operably associated with the door guiding tracks and with the operating cable and is mounted on the door at each side adjacent to the bottom edge of the door.

Each fixture includes a cam type dog having a serrated working surface to grip the guide track. The cam dog is disposed at one side of a flange, or guide rail of the track, with a door guiding roller disposed directly opposite the dog on the other side of this flange and within the track. The operating arm at its free end is connected to the cable by means of a link clipped around the cable to hold the operating arm in a vertical position parallel to the cable and track, whereby the fixture may move vertically relative to the track without restricting the movements of the door.

However, in the event of a cable breakage the cam operating arm will be released by the freedom of the cable and will be swung about its pivotal axis to bring the serrated cam dog into immediate engagement with the guide track flange to stop the doors downward movement and thus preventing its fall. It is important to note that the door guiding roller in the track and the cam dog at the opposing side of the track flange are operatively tied together by a metal strap, or tie plate, so that the two parts cannot move apart, or spread beyond their fixed dimension.

The guide roller is mounted on an axle and the dog and operating arm are mounted on an axle disposed in spaced relation to the roller axle and it is these axles that are tied together by the metal strap to prevent the axles from separating and thus hold the roller and cam dog in a fixed operating relationship. A coil spring operatively encircles the cam dog axle and it is this spring that rotates this axle and the cam dog and operating arm, when the cable breaks, to swing the serrated dog member into engagement with the track flange and thus prevent the door from dropping. The two axle members are operatively mounted in a bracket assembly secured on the door.

DESCRIPTION OF THE DRAWINGS

As shown in the drawings the invention comprises a structural arrangement that illustrates the features of the invention as herein described and wherein.

DESCRIPTION OF PREFERRED EMBODIMENT

Figure 1:
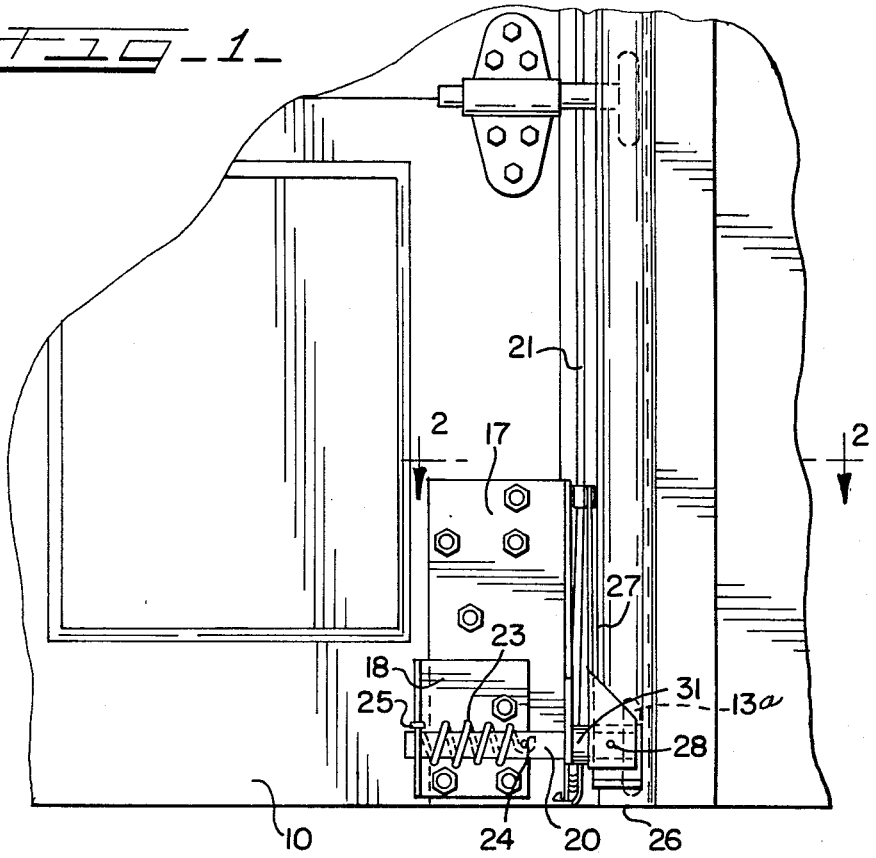
FIG. 1 is an inside elevational view of a portion of a lift type overhead door in the down position showing the fixture of this invention applied.
Figure 2:
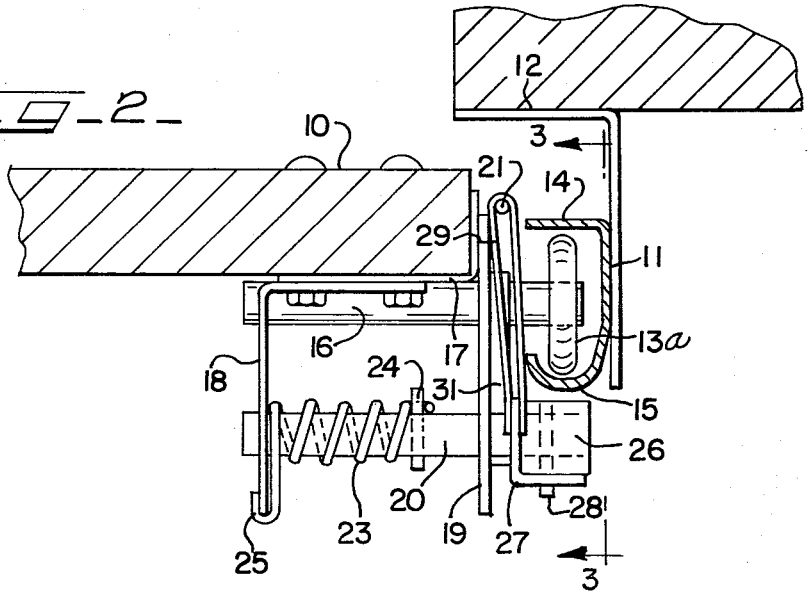
FIG. 2 is a plan sectional view through the door and guide track, taken on the line 2—2 of FIG. 1 showing the fixture secured to the door and mounting the operating parts of the invention and revealing the relationship of the guide roller and cam dog to the track.
Figure 4:
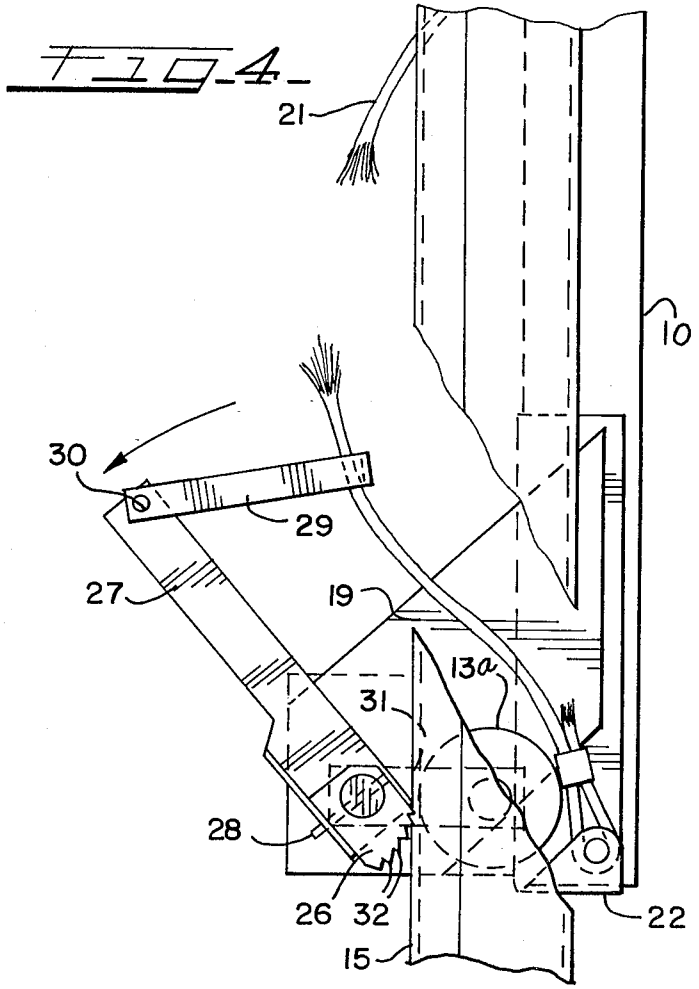
FIG. 4 also is a side elevational view similar to FIG. 3, but showing fixture under a broken cable condition with the cam dog engaging the track backed up by the guide roller at the opposite side of a track flange.
Figure 3:
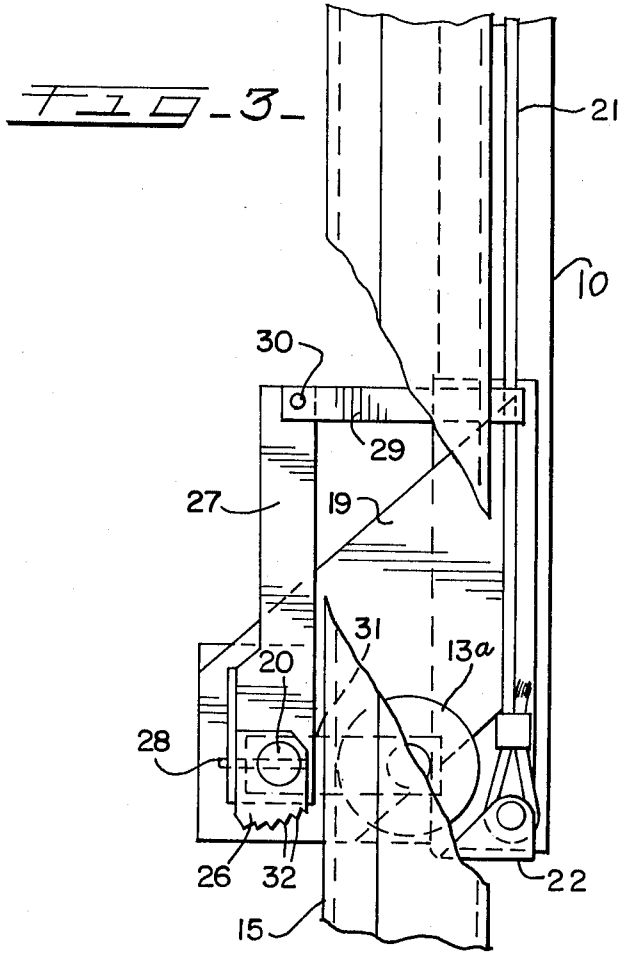
FIG. 3 is a side elevational view of the fixture as applied on the door and also showing the positions of the roller and cam dog relative to the track with the cam dog and its operating lever in normal vertical position.

In the drawings, the reference character 10 identifies a door of the overhead type that operates in vertical tracks 11 at opposite sides of the door and having horizontal track portions overhead in which the door is supported when in the raised position. The tracks 11 are each fixedly mounted to an angle shaped door jamp 12 and the door is guided in the tracks by series of rollers 13 and **13*a* at respective sides of the door. The tracks 11 each include a flange 14 and an opposite curved, or rebent flange 15 and the rollers 13 and 13*a*** are retained between these flanges for vertical movement in the tracks.

The roller 13*a* associated with each fixture is mounted on a heavy duty axle shaft 16 and this axle shaft is mounted in a supporting bracket assembly comprised of a door bottom fixture 17, an inner angle 18 and a spaced adapter plate 19 at the edge of the door to provide a generally channel shaped mounting fixture with the axle 16 extending through the plate 19 and the angle 18 to provide spaced bearing supports for the axle 16. A second axle shaft 20 extends through the plate 19 and angle flange 18 in inwardly spaced relation to the axle 16 for a purpose hereinafter to appear.

The door 10 normally is supported by means of a cable system 21 operating over suitable drums (not shown) and a counterbalance spring (also not shown) by means of which the door is adapted to be actuated easily between a vertical lowered position when the door is closed and a horizontal overhead position when the door is open. The cable is attached to the door at each side adjacent to the bottom of the door by means of an anchor bracket 22 of the bottom fixture 17.

The axle shaft 20 is spring actuated in a rotary direction and for this purpose a spring 23 encircles the shaft and is anchored at one end to the shaft by means of a roll pin 24 and at its other end is anchored to the inwardly directed flange of the angle 18, as at 25 whereby to exert a torsional force on the shaft. In this manner, the spring exerts a rotary force on the axle shaft in a counterclockwise direction of the right hand fixture. A cam dog 26 with an operating arm 27 is anchored on the other end of the shaft 20 by means of a roll pin 28 and the free end of the upwardly extending arm 27 is connected to the cable 21 by means of a link strap 29 which extends around the cable to clip the arm 27 to the cable and is pivotally connected at its opposite end to the operating arm, as at 30.

The cam dog 26 is located outside the flange 15 of the door guiding track 11 and is disposed directly opposite the roller 13*a* at the other side of the flange 15, inside the track and so long as the cable 21 remains intact the cam 26 and the operating arm 27 will maintain an upright position, with the cam and the arm in generally parallel relationship to the track and to the cable 21, with the cam and arm clear of the track flange 15 so that they are free to operate vertically relative to the track without any frictional interference between these parts and the track flange 15, so that door 10 is freely operable between raised and lowered positions. The axle 20 mounting the cam dog 26 and the axle 16 mounting the guide roller 13*a* are maintained in a fixed spaced relationship by means of a tie strap 31 so that their positions relative to the track flange 15 remain unchanged so long as the operating arm 27 stays vertical as secured by the clipped connection 29 to the cable 21.

However, if the cable 21 breaks the clipped connection 29 will be released by the broken cable and the operating arm 27 will swing inwardly, thus rotating the cam dog 26 into positive engagement with the track flange 15, with the roller 13*a* acting as a backup at the opposite side of the flange because the tie strap 31 will hold the roller and cam in a fixed spaced relationship. The rotation of the axle 20 is rapidly effected by the spring 23 when the cable connection 29 is released by the breaking of the cable. In this manner, the operating arm 27 and the cam 26 are caused to rotate quickly and bring the cam into positive engagement with the track flange 15 to prevent the door from moving downwardly. The cam 26 is provided with a plurality of sharp teeth 32 which grab the track flange securely and immediately prevent any possibility of the door 10 moving in a downward direction when the cable 21 breaks.

Typically, a cable 21 is disposed at each side of the door 10 and similarly a counterbalance spring (not shown) is also mounted at each side of the door in association with the respective cables. If one cable breaks at either side of the door the equal counterbalancing force of the two springs is lost but the engagement of the serrated cam dog 26 with the one track where the cable break is located is sufficient to grab the track at that side and prevent the door from moving in a downward direction. If for some reason both cables should break the door holding action of the cams 26 would be equally effective to prevent the door from falling.

The primary purpose of this overhead door fixture is to provide a positive stop against the possibility of the door falling in the event of failure of one or both supporting cables. In normal operation of the door the stop fixture will always stay in the non-track-engaging condition where the cable clip 29 holds the operating arm 27 in vertical position with the serrated cam 26 clear of the track flange 15. In this condition of the fixture the cam dog 26 will not grab the track flange 15 but will allow the cam and operating arm to move up and down the track freely without engaging the track flange.

If either door supporting cable breaks, which in ordinary circumstances would allow a door without this fixture to fall, this releases the connection 29 and the spring 23 will immediately rotate the shaft 20 in counterclockwise direction, thus swinging the operating arm 27 inwardly and rotate the cam dog 26 into positive gripping relationship with the track flange 15 to stop the door from any possibility of downward movement. The dog 26 is backed up by the roller 13*a*, which is held at a fixed dimension relative to the dog by the tie strap 31, thus assuring a positive gripping of the track flange 15 between the elements 26 and 13*a*.

The flange 15, in effect, is sandwiched between the dog 26 and roller 13*a* and the multiplicity of sharp teeth 32 are adapted to dig into the track flange 15 when the cam dog is rotated to engage the track so that the track then functions as the support for the door. It should be noted that when the dog 26 is brought to bear on the track flange 15, the camming action of the dog plus the weight of the door effectively provides the required grabbing, or gripping action of the dog and back-up roller to not only stop the doors downward movement but positively to prevent the door from falling.

The tie plate 31, adaptor plate 19 and the angle flange 18 all act together to maintain the operative relationship of the axles 16 and 20 and the roller 13*a* and dog 26 to preserve the proper spacing between these parts to obtain the desired engagement of the track flange 15.

CONCLUSION

From the foregoing, it will be seen that a door stopping fixture has been provided for a lift type overhead door of the counterbalanced cable supported variety, that operates in guide tracks by means of guide rollers, wherein a fixture is provided at each side of the door with a pivoted locking cam dog adapted to swing into positive engagement with one side of a track flange and backed up by a guide roller on the other side of the flange and tied together in fixed spaced relationship by a tie plate clipped to the cable so that if the cable breaks the tied relationship is released and the cam dog automatically swung to the track engaging position.

What is claimed is:

1. In an overhead door arrangement, a cable supporting the door, a guide track for the door, a flange on said track, a guide roller in the track behind said flange, a mounting fixture secured to the door, an operating shaft for said roller mounted in said fixture, a pivoted cam dog mounted on said fixture at the outer side of said flange opposite said roller, an operating arm on said cam dog normally extending generally parallel to said flange, a link connecting the free end of said arm with said cable, said cam dog having multiple teeth on one face thereof, said operating arm assuming an acute angle relative to said flange when said link is released upon breakage of said cable, and said teeth directly engaging said flange to grip such flange between the teeth and said guide roller when the operating arm assumes said acute angle to thereby stop downward movement of said door.

2. An overhead door arrangement as set forth in claim 1 wherein said fixture includes a shaft in spaced relation from said operating shaft mounting said cam dog, and a tie strap connection between said shafts maintaining said spaced relation.

3. An overhead door arrangement as set forth in claim 2 including a spring actuating said shaft mounting said cam dog to rotate said shaft and the cam dog when the cable breaks whereby to effect engagement of the cam dog with said flange.

4. An overhead door arrangement as set forth in claim 3 wherein said tie strap connection results in a gripping action on said flange between the cam dog and roller when the cam dog is rotated.

5. An overhead door arrangement as set forth in claim 4 wherein said mounting fixture is generally channel shape having widely spaced flanges, and said shafts have spaced bearing supports in said flanges.

6. An overhead door arrangement as set forth in claim 5 wherein said spring comprises a torsionally acting spring encircling said shaft mounting the cam dog with one end anchored to such shaft and its opposite end anchored to one of said widely-spaced flanges.

* * * * *